US011408383B2

(12) United States Patent
Fisch et al.

(10) Patent No.: US 11,408,383 B2
(45) Date of Patent: Aug. 9, 2022

(54) FUEL PUMP ASSEMBLY WITH ELECTRIC MOTOR FUEL PUMP AND FLUID DRIVEN FUEL PUMP

(71) Applicant: Walbro LLC, Tucson, AZ (US)

(72) Inventors: Elton J. Fisch, Caro, MI (US); Douglas W. Salowitz, Jr., North Branch, MI (US); Edward J. Talaski, Caro, MI (US)

(73) Assignee: Walbro LLC, Cass City, MI (US)

( * ) Notice: Subject to any disclaimer, the term of this patent is extended or adjusted under 35 U.S.C. 154(b) by 0 days.

(21) Appl. No.: 17/291,442

(22) PCT Filed: Nov. 1, 2019

(86) PCT No.: PCT/US2019/059346
§ 371 (c)(1),
(2) Date: May 5, 2021

(87) PCT Pub. No.: WO2020/106430
PCT Pub. Date: May 28, 2020

(65) Prior Publication Data

US 2022/0003193 A1 Jan. 6, 2022

Related U.S. Application Data

(60) Provisional application No. 62/769,810, filed on Nov. 20, 2018.

(51) Int. Cl.
*F02M 37/02* (2006.01)
*F02M 37/10* (2006.01)
*F02M 37/18* (2006.01)

(52) U.S. Cl.
CPC ..... *F02M 37/025* (2013.01); *F02M 37/10* (2013.01); *F02M 37/18* (2013.01)

(58) Field of Classification Search
CPC ..... F02M 37/025; F02M 37/18
See application file for complete search history.

(56) References Cited

U.S. PATENT DOCUMENTS 4,951,699 A * 8/1990 Lipman ..... F02M 37/0017 137/142
5,070,849 A * 12/1991 Rich ..... F04B 23/14 123/514

(Continued)

FOREIGN PATENT DOCUMENTS

DE 4111341 C2 * 9/1993 ..... B60K 15/077
JP 2003172222 A 6/2003

(Continued)

OTHER PUBLICATIONS

Written Opinion & International Search Report for PCT/US2019/059346 dated Apr. 10, 2020, 12 pages.

*Primary Examiner* — Kevin R Steckbauer
(74) *Attorney, Agent, or Firm* — Reising Ethington P.C.; Matthew J. Schmidt

(57) ABSTRACT

In at least some implementations, an assembly includes a reservoir, a primary fuel pump having an inlet in communication with the reservoir's internal volume, an outlet, a motor and a pumping element driven by the motor and a secondary fuel pump with a body having first and second inlets and an outlet. The first inlet receives fuel from the primary fuel pump and a nozzle is communicated with the first inlet and fuel flows out of the nozzle into the body via the first inlet. The second inlet is in communication with the reservoir inlet, and the outlet is in communication with the internal volume. The flow of fuel through the nozzle draws fuel from the fuel source through the second fuel inlet and that fuel is combined with the flow of fuel from the nozzle and discharged into the reservoir.

20 Claims, 5 Drawing Sheets

(56) References Cited

U.S. PATENT DOCUMENTS 5,110,265 A * 5/1992 Kato ..... F04D 5/002 417/279
5,218,942 A * 6/1993 Coha ..... F02M 37/18 123/514
5,456,235 A * 10/1995 Porter ..... F02M 37/20 123/514
5,649,514 A * 7/1997 Okada ..... B01D 35/027 123/514
5,680,847 A * 10/1997 Begley ..... F02M 37/103 123/509
6,149,399 A * 11/2000 Bowser ..... F02M 37/103 417/279
6,155,793 A * 12/2000 Tuckey ..... F02M 37/106 417/89
6,230,691 B1 * 5/2001 Coha ..... F02M 37/10 137/574
6,260,542 B1 * 7/2001 Kochsmeier ..... F02M 37/106 137/571
6,260,543 B1 * 7/2001 Chih ..... F02M 37/106 137/574
6,283,142 B1 * 9/2001 Wheeler ..... F02M 37/0094 123/514
6,405,717 B1 * 6/2002 Beyer ..... F02M 37/025 123/514
6,408,830 B1 * 6/2002 McGrath ..... F02M 37/106 123/514
6,457,945 B2 * 10/2002 Kleppner ..... F02M 37/106 137/590
6,832,602 B2 * 12/2004 Tanimura ..... F02M 37/106 123/509
6,871,640 B2 * 3/2005 Atwood ..... F04F 10/00 137/142
6,907,899 B2 * 6/2005 Yu ..... B60K 15/03 123/514
7,066,153 B2 * 6/2006 Vitalis ..... F02M 37/0094 417/198
7,069,913 B1 * 7/2006 Crary ..... F02M 37/106 123/514
7,069,914 B2 * 7/2006 Nagata ..... F02M 37/025 123/514
7,216,633 B2 * 5/2007 Attwood ..... F02M 37/025 137/571
7,303,378 B2 * 12/2007 Kleppner ..... F02M 37/106 417/87
7,387,111 B2 * 6/2008 Yu ..... F02M 37/106 123/514
7,387,112 B2 * 6/2008 Oohashi ..... F04F 5/10 417/79
7,506,636 B2 * 3/2009 Lubinski ..... F02M 37/18 123/511
7,523,745 B2 * 4/2009 Troxler ..... F02M 37/14 73/317
7,533,904 B2 * 5/2009 Koike ..... B62J 35/00 280/833
7,571,716 B2 * 8/2009 Tipton ..... F02M 37/106 123/468
7,588,017 B2 * 9/2009 Briggs ..... F04D 5/005 123/509
7,617,814 B2 * 11/2009 Leppert ..... F02M 37/0029 123/514
7,658,181 B2 * 2/2010 Dickenscheid ..... F02M 37/025 137/572
7,757,671 B2 * 7/2010 Danjo ..... F02M 37/106 123/509
7,874,811 B2 * 1/2011 Kieninger ..... F04F 5/54 123/514
7,874,812 B2 * 1/2011 Braun ..... F02M 37/025 417/198
7,913,670 B2 * 3/2011 Holtz ..... F04F 5/44 417/151
8,206,126 B2 * 6/2012 Wattai ..... F04D 5/005 417/89
8,459,960 B2 * 6/2013 Mason ..... F04F 5/10 137/565.22
8,511,340 B2 * 8/2013 Smid ..... F04F 5/46 417/186
8,726,886 B2 * 5/2014 Mason ..... F02M 37/0088 417/76
8,820,298 B2 * 9/2014 Attwood ..... F02M 37/106 123/456
8,926,292 B2 * 1/2015 Becker ..... F04F 5/50 417/89
9,039,385 B2 * 5/2015 Myers ..... F01P 11/04 417/151
9,151,257 B2 * 10/2015 Jeon ..... F02M 37/103
10,138,906 B2 * 11/2018 Hayashi ..... F02M 37/106
10,364,759 B2 * 7/2019 Koike ..... F02M 37/08
10,690,096 B2 * 6/2020 Hayashi ..... F02B 37/025
10,780,794 B2 * 9/2020 Zenner ..... H01M 10/66
11,008,987 B2 * 5/2021 Cotton ..... F02M 37/20
11,085,407 B2 * 8/2021 Anderson ..... F02M 37/0029
2001/0026760 A1 * 10/2001 Kleppner ..... F02M 37/025 417/423.3
2002/0073975 A1 * 6/2002 McGrath ..... F02M 37/106 123/518
2003/0062031 A1 * 4/2003 Tanimura ..... F02M 37/025 123/509
2004/0140009 A1 * 7/2004 Yu ..... F02M 37/0094 137/565.22
2004/0177886 A1 * 9/2004 Nagata ..... F02M 37/025 137/571
2004/0182454 A1 * 9/2004 Atwood ..... F04F 10/00 137/574
2004/0219029 A1 * 11/2004 Kleppner ..... B60K 15/077 417/77
2005/0183781 A1 * 8/2005 Vitalis ..... F02M 37/0094 137/565.22
2005/0241621 A1 * 11/2005 Kieninger ..... F02M 37/025 123/509
2005/0286103 A1 * 12/2005 Yu ..... F02M 37/106 123/509
2006/0021603 A1 * 2/2006 Nagata ..... F02M 37/106 123/514
2007/0023218 A1 * 2/2007 Koike ..... B62J 35/00 180/219
2007/0062492 A1 * 3/2007 Attwood ..... F02M 37/025 123/514
2007/0104589 A1 * 5/2007 Marx ..... F02M 37/025 123/514
2007/0125344 A1 * 6/2007 Troxler ..... B60K 15/03 73/866.5
2007/0217921 A1 * 9/2007 Oohashi ..... F02M 37/025 123/514
2007/0217922 A1 * 9/2007 Braun ..... F02M 37/025 417/198
2008/0173282 A1 * 7/2008 Briggs ..... F02M 37/025 123/506
2008/0184971 A1 * 8/2008 Lubinski ..... F02M 37/0058 123/511
2008/0190397 A1 * 8/2008 Tipton ..... F02M 37/106 123/468
2008/0273992 A1 * 11/2008 Killion ..... F04C 11/005 417/189
2009/0013970 A1 * 1/2009 Danjo ..... F02M 37/106 123/509
2009/0020894 A1 * 1/2009 Holtz ..... F02M 37/025 261/37
2009/0064973 A1 * 3/2009 Dickenscheid ..... F02M 37/025 123/495
2009/0223492 A1 * 9/2009 Leppert ..... F02M 37/0094 417/151
2009/0252618 A1 * 10/2009 Gensert ..... F04F 5/10 417/187
2009/0290994 A1 * 11/2009 Kieninger ..... F04F 5/463 417/198
2009/0304527 A1 * 12/2009 Wattai ..... F04D 5/005 417/151

(56) References Cited

U.S. PATENT DOCUMENTS

| | | | | |
|---|---|---|---|---|
| 2010/0202898 | A1* | 8/2010 | Mason | F04F 5/463 417/151 |
| 2010/0290924 | A1* | 11/2010 | Becker | F04F 5/54 417/198 |
| 2010/0319793 | A1* | 12/2010 | Smid | F04F 5/44 137/565.22 |
| 2011/0000468 | A1* | 1/2011 | Malec | F02M 37/025 123/509 |
| 2011/0132328 | A1* | 6/2011 | Attwood | F02M 37/0094 123/456 |
| 2013/0047966 | A1* | 2/2013 | Mason | F02M 37/106 417/198 |
| 2013/0061960 | A1* | 3/2013 | Jeon | F02M 37/103 137/544 |
| 2013/0133870 | A1* | 5/2013 | Myers | F02M 37/025 417/151 |
| 2014/0239097 | A1* | 8/2014 | Cotton | F02M 37/20 239/533.2 |
| 2016/0102683 | A1* | 4/2016 | Hayashi | F04F 5/24 264/254 |
| 2018/0245525 | A1* | 8/2018 | Koike | F02D 41/042 |
| 2019/0170097 | A1* | 6/2019 | Hayashi | F02M 37/10 |
| 2019/0225112 | A1* | 7/2019 | Zenner | H01M 10/653 |
| 2019/0242341 | A1* | 8/2019 | Anderson | F02M 37/10 |

FOREIGN PATENT DOCUMENTS

| | | | | |
|---|---|---|---|---|
| JP | 2008180112 | A * | 8/2008 | F02M 37/10 |
| JP | 2008180112 | A | 8/2008 | |

* cited by examiner

FUEL PUMP ASSEMBLY WITH ELECTRIC MOTOR FUEL PUMP AND FLUID DRIVEN FUEL PUMP

REFERENCE TO RELATED APPLICATIONS

This application claims the benefit of U.S. Provisional Application Ser. No. 62/769,810 filed on Nov. 20, 2018 the entire contents of which are incorporated herein by reference in its entirety.

TECHNICAL FIELD

The present disclosure relates generally to a fuel pump assembly that includes an electric motor fuel pump and a fluid driven fuel pump.

BACKGROUND

Fuel systems for combustion engines can include a fuel pump assembly that pumps fuel from a fuel tank to an engine. The fuel pump generally is carried by some structure either within or outside of the fuel tank. Fuel is taken into the fuel pump through an inlet, the pressure of the fuel is increased, and the fuel is discharged from the fuel pump and delivered to the engine.

SUMMARY

In at least some implementations, a fuel pump assembly includes a reservoir having an internal volume and an inlet that communicates with the internal volume, a primary fuel pump having an inlet in communication with the internal volume, an outlet through which fuel is discharged under pressure, an electric motor and a pumping element driven by the electric motor to take fuel into the inlet and discharge fuel from the outlet and a secondary fuel pump. The secondary fuel pump has a body that defines a first inlet, a second inlet and an outlet. The first inlet receives at least some of the fuel discharged from the primary fuel pump outlet and a nozzle is carried by the body or otherwise communicated with the first inlet so that fuel that flows out of the nozzle flows into the body via the first inlet. The second inlet is in communication with the reservoir inlet, and the outlet is in communication with the internal volume. The flow of fuel through the nozzle creates a drop in pressure in the area of the second fuel inlet to draw fuel from the fuel source through the second fuel inlet and the fuel drawn in through the second fuel inlet is combined with the flow of fuel from the nozzle. The combined fuel flows are discharged from the secondary fuel pump outlet and into the internal volume.

In at least some implementations, the nozzle is received at least partially in the body and the body defines an area downstream of the nozzle that is larger in size than the flow area of the nozzle. The body may be formed as a single piece of material such that the first inlet, second inlet and the outlet are features integrally formed in the same component. The body may be formed from a material conductive to electrostatic charges.

In at least some implementations, a flow controller is carried by the reservoir and fuel flow from the secondary fuel pump outlet is directed into the reservoir, and the flow controller includes a cavity and the outlet is defined at least in part by an outlet tube having an end that is received in the cavity. The outlet may be coupled to a first end of an outlet tube and a second end of the outlet tube is received within the cavity. The flow controller may include a surface that is at an angle of between 45 and 90 degrees relative to the direction of fuel flow out of the secondary fuel pump outlet. The flow controller may include an opening above the level of the second end of the outlet tube relative to the direction of the force of gravity.

In at least some implementations, at least a portion of the second inlet or of a passage coupled to the second inlet is at an acute included angle of between 0 and 60 degrees relative to the direction of the force of gravity. In at least some implementations, the outlet is coupled to a first end of an outlet tube, and wherein the outlet tube is bent and includes a portion that is located above a height of the second outlet relative to the force of gravity.

In at least some implementations, a pick-up tube has a first end coupled to the reservoir and communicated with the inlet of the reservoir, and the pick-up tube has a second end spaced from the reservoir. In at least some implementations, an intake tube is coupled at a first end to the reservoir and communicated with the inlet of the reservoir, and the intake tube has a second end coupled to the second inlet of the body. In at least some implementations, an intake tube is coupled at a first end to the second inlet of the body and a second end that is remote from the reservoir. The intake tube may extend from within the internal volume to a location outside of the internal volume. The intake tube may be defined in part by a passage formed in the reservoir.

In at least some implementations, a carrier is received within the reservoir internal volume and has a wall that supports the primary fuel pump within the internal volume, and wherein the body is formed in the same piece of material as at least a portion of the carrier.

In at least some implementations, the primary fuel pump includes an outlet body that defines the outlet of the primary fuel pump, and a hollow projection that defines a second outlet of the primary fuel pump, and a portion of the body of the secondary fuel pump that defines the first inlet is received over at least part of the hollow projection so that the body of the secondary fuel pump is coupled to the outlet body.

BRIEF DESCRIPTION OF THE DRAWINGS

The following detailed description of certain embodiments and best mode will be set forth with reference to the accompanying drawings, in which.

DETAILED DESCRIPTION

Figure 1:
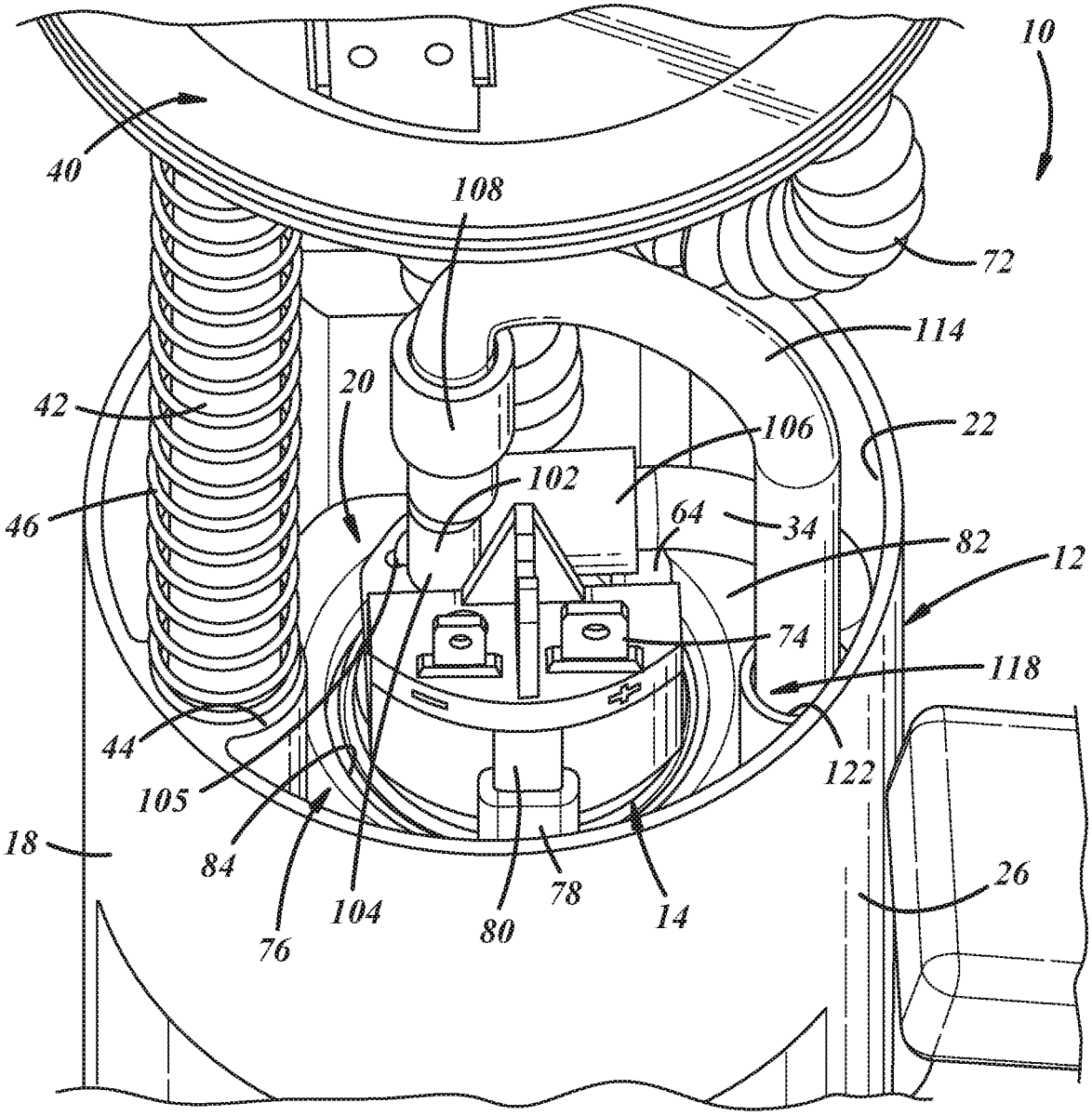
FIG. 1 is a perspective view of a portion of a fuel pump assembly illustrating a reservoir, mounting flange coupled to the reservoir and certain components within the reservoir.

Referring in more detail to the drawings, FIG. 1 illustrates a fuel pump assembly 10 having a reservoir 12 in which a supply of fuel is contained and a primary fuel pump 14 to pump fuel from the reservoir 12 for use by an engine. The reservoir 12 may include or be defined by a main body 18 that defines an internal volume 22 in which fluid is retained. The fuel pump 14 takes in fuel from the internal volume 22, increases the pressure of the fuel and discharges fuel under pressure for delivery to the engine. Some of the fuel discharged from the primary fuel pump 14 is directed to a secondary fuel pump 20 which may be a fluid driven jet pump that moves fuel from a fuel tank 24 into the internal volume 22 of the reservoir 12. In this way, fuel is moved from the fuel tank 24 into the reservoir 12 and then from the reservoir to the engine.

Figure 2:
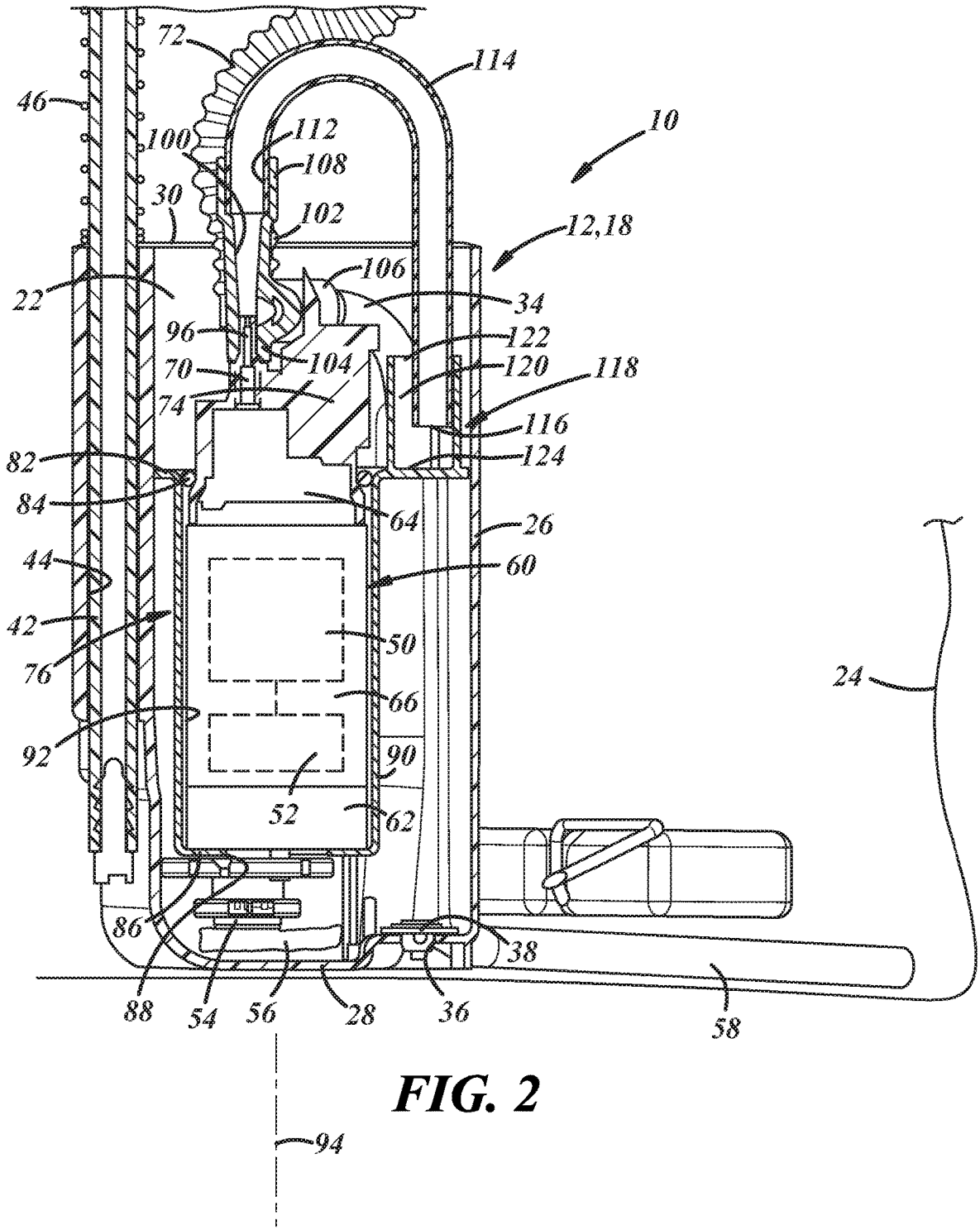
FIG. 2 is a sectional view of the fuel pump assembly.
Figure 5:
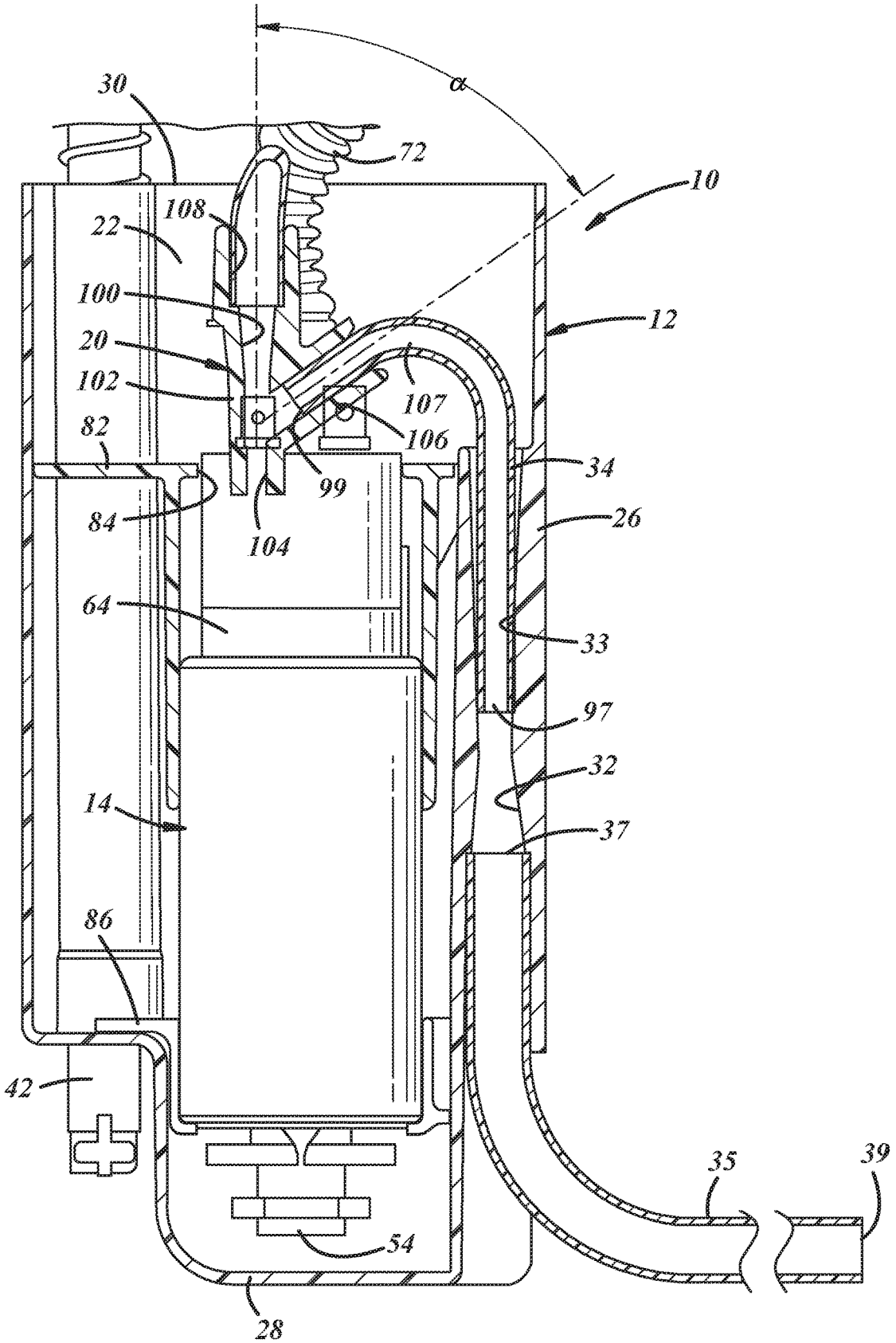
FIG. 5 is a sectional view of a fuel pump assembly showing the intake tube coupled to or communicating with an inlet of the reservoir and a pick-up tube that extends into a fuel tank in which the pump assembly is received.
Figure 6:
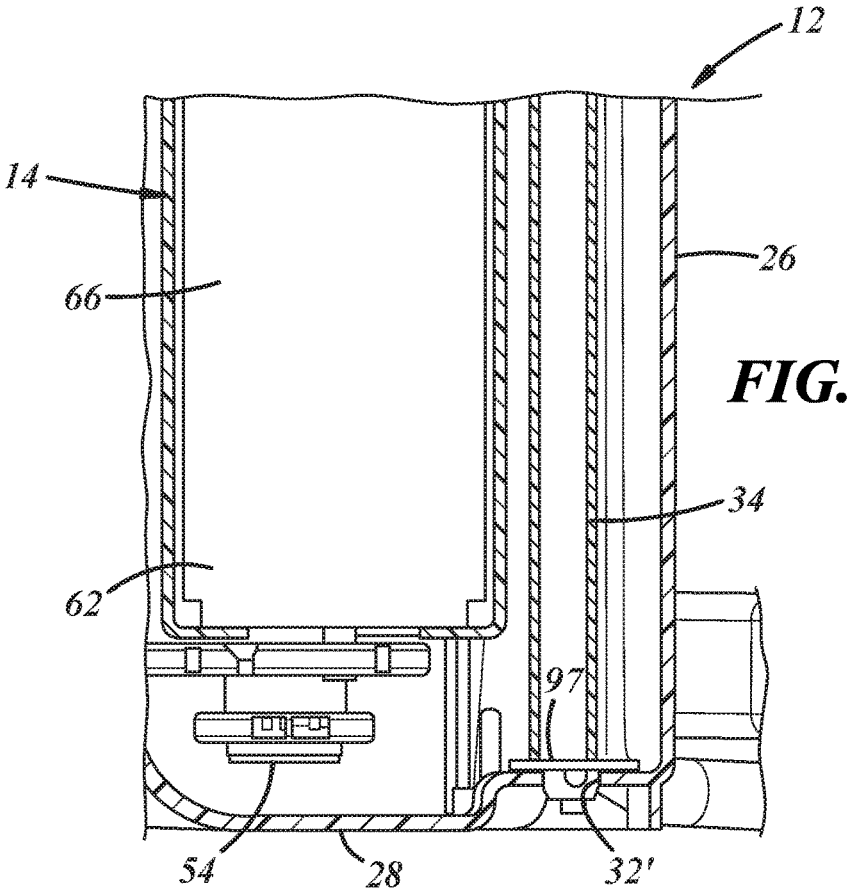
FIG. 6 is a sectional view of a lower portion of a fuel pump assembly illustrating a second end of the inlet tube coupled to or communicating with an inlet of the reservoir.

The reservoir 12 may be of any desired shape and provide any desired internal volume 22. As shown in FIG. 2, the main body 18 may have a generally cylindrical sidewall 26 that is closed at one end by a bottom wall 28 and open at its other end 30 so that components (e.g. the fuel pump 14) can be received at least partially within the internal volume 22. In at least some implementations, the reservoir 12 includes an inlet 32 (FIG. 5) through which fuel is admitted into the internal volume 22, and the inlet 32 may be communicated with an intake passage or tube 34 of the secondary fuel pump 20 so that the secondary fuel pump 20 draws fuel from the fuel tank 24 through the inlet 32. The intake tube 34 may be received at least partially within a passage 33 or cavity that may be integrally formed in the reservoir 12 and which may define or communicate with the inlet 32. In at least some implementations, a pick-up tube 35 may be coupled to or communicated with the inlet 32 so that the intake tube 34 draws fuel through the pick-up tube 35 and the reservoir inlet 32. The pick-up tube 35 may have a first end 37 coupled to the reservoir 12 (e.g. within the passage 33 which may extend beyond the inlet 32 as shown in FIG. 5) and/or the intake tube 34, and may extend away from the reservoir 12 to a free end or second end 39 that may be communicated with a portion of the fuel tank 24 remote or spaced from the reservoir 12. For example, the fuel tank 24 may include a sump or lower portion and the pick-up tube 35 may extend into the sump so that the pump assembly 10 may access all or nearly all of the fuel in the tank 24. Alternatively, as shown in FIG. 6, the intake tube 34 may be coupled to the reservoir at or otherwise communicated with an inlet 32' formed in a lower wall of the reservoir, without any pick-up tube. Hence, in this example, the second pump draws fuel from the area of the tank adjacent to the inlet 32'.

A second inlet 36 (FIG. 2) in the reservoir 12 may be provided to permit liquid fuel to enter the internal volume 22 when the level of fuel in the fuel tank is greater than the height or level of the second inlet and of the fuel in the internal volume 22. A check valve 38 may be provided at the second inlet 36 to permit fuel flow from the tank 24 into the internal volume 22 but to prevent fuel in the internal volume 22 from flowing to the fuel tank 24 through the second inlet 36. This prevents the reservoir 12 from draining through the second inlet 36 when the level of the fuel in the tank 24 is lower than that in the internal volume 22. The reservoir 12 may be formed from any desired material suitable for use with the fuel being pumped. The reservoir 12 may be received within an interior of the fuel tank 24 in which a supply of fuel is maintained.

To retain the reservoir 12 within the fuel tank 24, the assembly may include a mounting flange 40 (part of which is shown in FIG. 1) adapted to be sealed to a wall of the fuel tank 24 over an opening through which the reservoir 12 is inserted into the fuel tank 24. The mounting flange 40 is coupled to the reservoir main body 18, such as by one or more supports 42 that may be slidably received within openings or passages 44 in the reservoir main body 18. A biasing member, such as a coil spring 46 may be received around one or more of the supports 42 and between the mounting flange 40 and the reservoir main body 18, to yieldably bias the main body 18 away from the mounting flange 40. When the mounting flange 40 is coupled to an upper wall of the fuel tank 24, the spring(s) 46 urge the main body 18 toward the bottom wall of the fuel tank 24 so that the even low levels of fuel within the tank 24 may be accessed by the fuel pump assembly 10.

The primary fuel pump 14 may include an electric motor 50 and a pumping element 52 driven by the motor 50. The pumping element 52 creates a pressure drop at an inlet 54 of the fuel pump 14 to draw fuel into the inlet 54, and increases the pressure of fuel taken into the pumping element 52 so that fuel is discharged from the fuel pump 14 under pressure. The pumping element 52 may be a of a positive displacement type, like a gerotor or screw pump, or a centripetal pump like a turbine type pump. The fuel pump inlet 54 may be arranged adjacent to the bottom wall 28 of the reservoir 12 so that all or nearly all of the fuel within the internal volume 22 can be taken into the primary fuel pump 14. A fuel filter 56 may be arranged at the inlet 54 and within the internal volume 22 to filter fuel before the fuel is drawn into the primary fuel pump 14. In addition to or instead, a fuel filter may be provided at one or both inlets 30, 32 of the reservoir 12, at the free end 39 of the pick-up tube 35 or at the second end 97 of the intake tube 34 to filter fuel as it enters the reservoir internal volume 22 and prior to being pumped by the primary fuel pump 14.

The motor 50 and pumping element 52 may be carried within a housing 60 of the fuel pump 14 which may include an inlet body 62 and an outlet body 64 at opposite ends of a cylindrical casing 66. The casing 66 may be fixed to the inlet and outlet bodies 62, 64 in any suitable way including crimping the ends of the casing 66 to the bodies and/or by weld, adhesive, fasteners or the like. The motor 50 and pumping element 52 may be received between the inlet and outlet bodies 62, 64, and may be supported at least in part by the bodies 62, 64. The inlet body 62 may define the inlet 54 to the fuel pump 14 through which fuel is taken in by the pumping element 52, and the outlet body 64 may define one or more outlets of the fuel pump 14 through which fuel is discharged from the fuel pump 14. In the example shown, the fuel pump 14 includes a first fuel outlet 68 through which fuel is discharged to the engine and a second fuel outlet 70 through which a flow of fuel is provided for the secondary fuel pump 20. The first and second fuel outlets 68, 70 may be defined at least in part by ports or passages in the outlet body 64. The first fuel outlet 68 may be coupled to one end of a tube 72 that has its other end coupled to a passage through the mounting flange 40. A fuel line may be coupled to the mounting flange 40 outboard of the fuel tank 24 and lead to a fuel rail or other component for delivery of fuel to the engine. In this way, fuel may be delivered from within the fuel tank 24 to a location outboard of the fuel tank. The outlet body 64 may include or receive one or more electrical connectors 74 or terminals via which electrical power is provided to the motor 50.

To retain the position of the fuel pump 14 within the reservoir 12, a carrier 76 in the internal volume 22 may receive, retain and/or engage at least part of the fuel pump 14. The carrier 76 may be formed separate from the reservoir main body 18 and coupled thereto in assembly, or it may be defined by one or more internal walls or structural features of the main body 18 that engage or support the fuel pump 14 within the reservoir, or some combination of the separately formed and integrally formed features. In the example shown in FIG. 1, the carrier 76 includes one or more retainers 78 that engage and may be connected to flanges or tabs 80 of the outlet body 64. The retainers 78 may extend from an upper wall 82 of the carrier 76 which may include an opening 84 through which the outlet body 64 extends, and through which the first fuel outlet 68 and second fuel outlet 70 extend. The carrier 76 may also include a lower wall 86, as shown in FIG. 2, which may also include an opening or cavity 88 in which the inlet body 62 is received and or through which the inlet 54 of the fuel pump 14 is communicated with a lower portion of the internal volume 22. A sidewall 90 may extend between the upper wall 82 and lower wall 86, or the upper wall 82 may be coupled to the reservoir main body 18 separately from the lower wall 86.

The first fuel outlet 68 and second fuel outlet 70 may both extend from and communicate with an interior 92 of the fuel pump housing 60 so that each receive fuel at about the same pressure. The outlets 68, 70 may be provided in any desired orientation and are shown as being separate passages in the outlet body 64 that are parallel or generally parallel with each other and parallel or generally parallel to a rotary axis 94 of the motor 50 (where generally in this instance means within 15 degrees). The second outlet 70 could instead be a tap, branch or "T" off of the first outlet 68, or vice versa, or the first and second outlets 68, 70 can be oriented in any other desired manner including implementations wherein one or both of the outlets 68, 70 extend through the inlet body 62 and/or casing 66 rather than the outlet body 64. The second outlet 70 may lead to or define part of the secondary pump 20 and provides an input fuel flow to the secondary fuel pump 20.

The secondary pump 20 utilizes the flow of fuel from the second outlet 70 to create a drop in a pressure that is communicated with the reservoir inlet 32 (and a pick-up tube 35 if included) to draw fuel from the fuel tank 24 through the reservoir inlet 32 (and pick-up tube 35). In at least some implementations, the secondary pump 20 includes a nozzle 96, jet or restriction that increases the velocity of fuel flowing therethrough and which leads to a larger area 98, which may be defined by part of a venturi or tapered portion of a passage or tube 100. Hence, the secondary fuel pump 20 may be a so-called jet pump. The increase in velocity of fuel discharged from the nozzle 96 causes a decrease in pressure and the area 98 downstream of the nozzle 96 which is communicated with the reservoir inlet 32 (and/or a pick-up tube) through the intake tube 34. The intake tube 34 is coupled at one end 97 (FIG. 5) to the reservoir at the inlet 32 (and/or pick-up tube) so that fuel that flows through the inlet enters the intake tube 34, and the intake tube 34 is communicated at its other end 99 (FIG. 4) with the area 98 downstream of the nozzle 96. Fuel that flows through the intake tube 34 may join the fuel discharged from the nozzle or jet 96 and the combined fuel flow may be discharged into the internal volume 22 to provide a supply of fuel within the internal volume 22. While shown in the illustrated example as being separate tubes, the intake tube 34 and pick-up tube 35 may be a single tube that extends between the secondary pump 20 and the fuel tank 24 and which may pass through an opening or port (e.g. inlet 32) in the reservoir body 18 or may be routed out through the open upper end 30 of the reservoir body 18. Further, part or all of the intake tube and/or pick-up tube may be part of the reservoir or carrier 76, that is, an opening or passage formed in the reservoir body 18 and/or the carrier 76.

Figure 4:
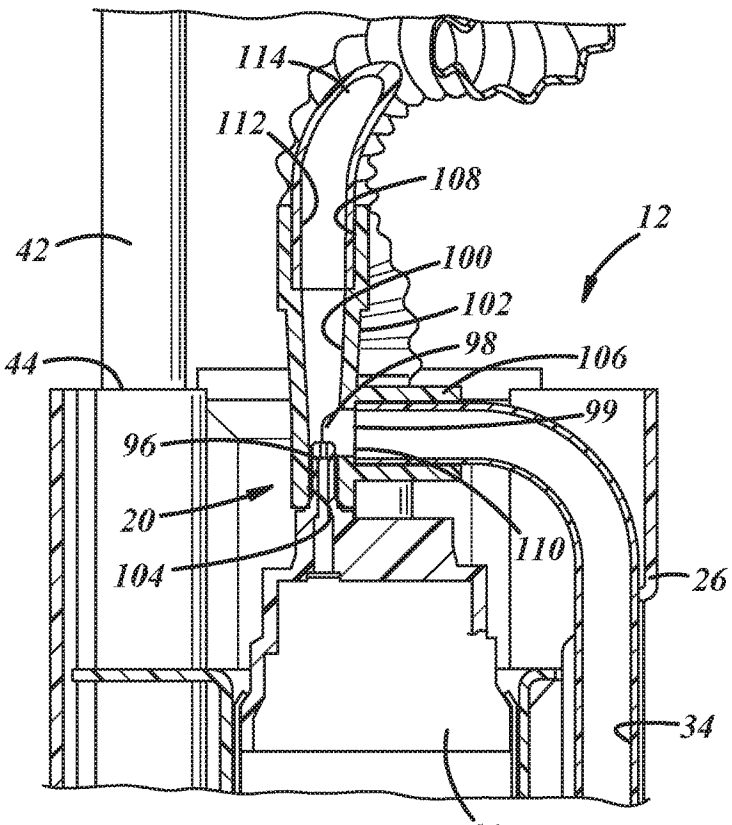
FIG. 4 is an enlarged sectional view of an upper portion of the fuel pump assembly illustrating an upper portion of a primary fuel pump, a second pump body and a first end of an intake tube.
Figure 3:
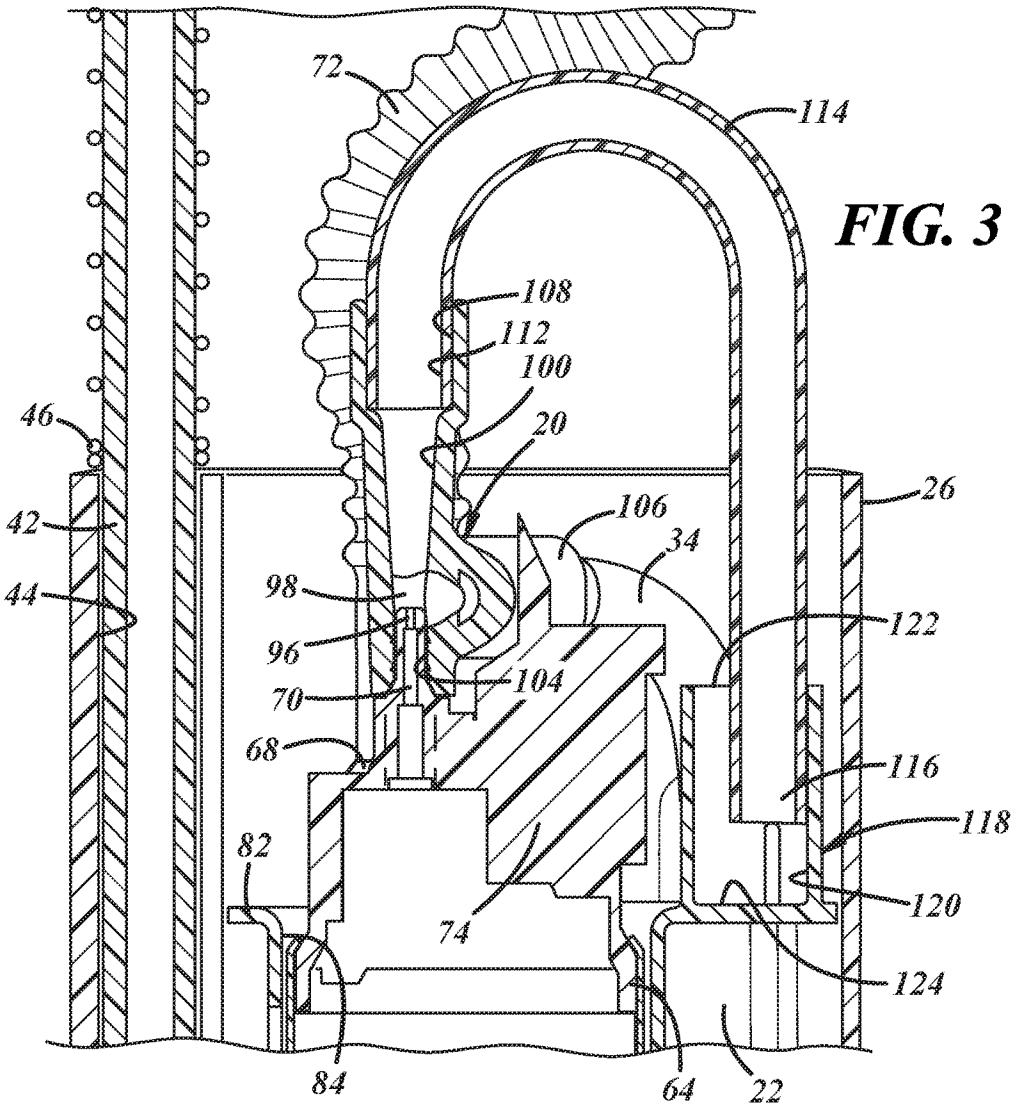
FIG. 3 is an enlarged sectional view of a portion of the fuel pump assembly.

In at least some implementations, such as is shown in FIGS. 2-4, a second pump body 102 is coupled to the fuel pump 14, such as at the outlet body 64 and includes a first inlet 104, a second inlet 106 and an outlet 108. The first inlet 104 is coupled to the second outlet 70 of the primary fuel pump 14 to receive fuel discharged from the second outlet 70. In at least some implementations, the second outlet 70 is defined at least in part by a hollow projection of the outlet body 64 and the inlet 104 is pressed onto and over the projection (e.g. in a fluid tight manner).

The second inlet 106 is communicated with the area 98 downstream of the nozzle 96 and receives or is otherwise coupled to the second end 99 of the intake tube 34 to receive fuel drawn through the reservoir inlet 32. The second inlet 106 may be defined by a nipple or projection onto which the second end 99 of the intake tube 34 is fitted (e.g. in a fluid-tight manner). As shown in FIG. 5, the second inlet 106 may be angled relative to the direction of the force of gravity so that the fuel enters the inlet 106 at a downward angle toward the area 98 downstream of the nozzle 96. With a sufficient upward angle and increase in vertical distance from the first inlet 106 to a peak height of the intake tube 34, fuel does not flow back out of the intake tube 34 and into the fuel tank 24 when the pump assembly 10 is operating. A pressure relief opening 105 (FIG. 1) may be provided, such as in the second pump body or a tube associated therewith, which may relieve the pressure in the second pump 20 and prevent siphoning of fuel when the fuel pump 14 is not operating. In at least some implementations, the inlet 106 or a portion of the intake tube 34 is arranged at an acute included angle $\alpha$ between 0 and 60 degrees relative to the direction of the force of gravity, which may be measured along the centerline or axis of the second inlet 106 or intake tube 34. And the peak height of the intake tube 34 (measured at a lowest inner surface of the tube 34 in the area of the peak height, shown in FIG. 5 at reference numeral 107) is at least 20 mm above the outlet of the nozzle 96. In the example shown in FIGS. 1-4, a check valve may be provided at the second inlet 106 or in the intake tube 34 or the inlet 32 to prevent the backflow of fuel through that fuel flow path and to the tank 24, as desired.

The outlet 108 receives fuel from one or both inlets 104, 106 of the second pump body 102 and is communicated with the internal volume 22 so that at least some and up to all of the fuel that exits the outlet 108 enters the internal volume 22. The outlet 108 may be coupled to a first end 112 of an outlet tube 114 that has its second end 116 received in the internal volume 22. The outlet tube 114 may be bent and include a portion located above the height of the second outlet 70, where above is relative to the force of gravity. The second end 116 of the outlet tube 114 may be received in or communicated with a flow controller 118.

As shown in FIGS. 2 and 3, the flow controller 118 may at least partially oppose flow out of the outlet tube 114 and create a puddle or volume of fuel around part or all of the second end 116 of the outlet tube 114. The second end 116 of the outlet tube 114 may then be wetted by liquid fuel which improves priming and the efficiency of the pump in use and may also inhibit reverse flow or air. In at least some implementations, the flow controller 118 is oriented at an angle of at least forty-five degrees and up to ninety degrees (e.g. perpendicular) relative to the direction of fluid flow out of the outlet tube 114. The flow controller 118 may include or be defined by a cavity 120 or reservoir in the upper wall 82, lower wall 86 or reservoir body 18, where the cavity 120 surrounds the second end 116 of the outlet tube 114 and includes an opening 122 above the level of the second end 116 of the outlet tube 114, relative to the direction of the force of gravity. Thus, the cavity 120 may contain a volume of fuel having a level above the second end 116 of the outlet tube 114 which inhibits air from entering the second end 116 of the outlet tube 114 and to help the outlet tube 114 stay full (or fuller) of liquid to improve pump performance and efficiency. In the example shown, the opening 122 is defined by an open upper end of the cavity 120 that is oriented in the opposite direction as the force of gravity and the second end 116 of the outlet tube 114 is oriented in the direction of the force of gravity and toward a bottom surface 124 of the component defining the cavity 120. When the cavity 120 is full of fuel, fuel overflows from the cavity 122 and into the internal volume 22 wherein that fuel is available to be pumped by the primary fuel pump 14. The first end 97 of the intake tube 34 may be coupled to the inlet 32 of the reservoir main body 18 which may be positioned below the level of the cavity 120, with respect to the force of gravity.

The second pump body 102 may be a simple, molded plastic component that integrally includes, and which may be formed in a single body, the two inlets 104, 106 and the outlet 108 all in communication with each other within the body 102. The second pump body 102 may be formed from an electrically conductive material that may facilitate the transmission away from the primary pump of electrostatic charges that may develop in the fuel pump assembly. The second pump body 102 may directly engage the primary pump 14, such as at the outlet body 64, and so may further be coupled to a grounded or metal element in or of the pump 14 to facilitate transmission of electrostatic charges and thereby reduce or eliminate the build-up of an electrostatic charge beyond a threshold, such as a charge that may cause a spark. An example may include implementations wherein the second outlet is or includes a brass part that contacts a brush spring of the motor (when a brushed motor is used in the primary fuel pump 14). In at least some implementations, the conductivity range or resistance range of the second pump body 102 is between $10^5$ and $10^9$ ohms per square.

The second pump body 102 may support, locate and retain the position of the intake tube 34 and outlet tube 114. The first inlet 104 and the outlet 108 may be arranged in-line with the flow of fuel out of the second outlet 70 of the primary fuel pump 14, which may be oriented vertically, against the force of gravity (or generally vertically which is within 20 degrees of vertical). Of course, other orientations may be used. The second pump body 102 may be of a relatively small size and may fit within a relatively small diameter reservoir 12, as desired. In at least some implementations, the second pump body 102 may be received within an envelope defined by the pump housing 60, in other words, the second pump body 102 may be axially offset but radially overlapped by the pump housing 60. That is, the second pump body 102 does not, in at least some implementations, extend radially outwardly relative to the primary pump housing 60 and is within a vertical extension of the periphery of the primary pump housing 60.

The jet or restriction 96 for the secondary fuel pump 20 may be defined as a molded-in feature of the second pump body 102, may be a separate insert that is press-fit or otherwise secured to the second pump body 102, or may be defined by or carried by the second outlet 70 of the outlet body 64. In the example shown, the second outlet 70 includes a reduced diameter section or jet 96 integrally provided within the outlet body 64 of the primary fuel pump 14. Providing the jet within the second pump body 102 may facilitate use of the same primary pump 14 in different applications needing different jet sizes or flow characteristics. Further, the second pump body 102 may include a tapered passage 100 that includes a reduced size in the area 98 closer to the nozzle or jet 96 and which increases in size toward the outlet 108. This tapered passage 100 may define a diverging portion of the passage or outlet 108 which may function like a diverging portion of a venturi to improve the pressure drop in the area of the second inlet 106 and improve the performance and efficiently of the secondary fuel pump 20.

Figure 7:
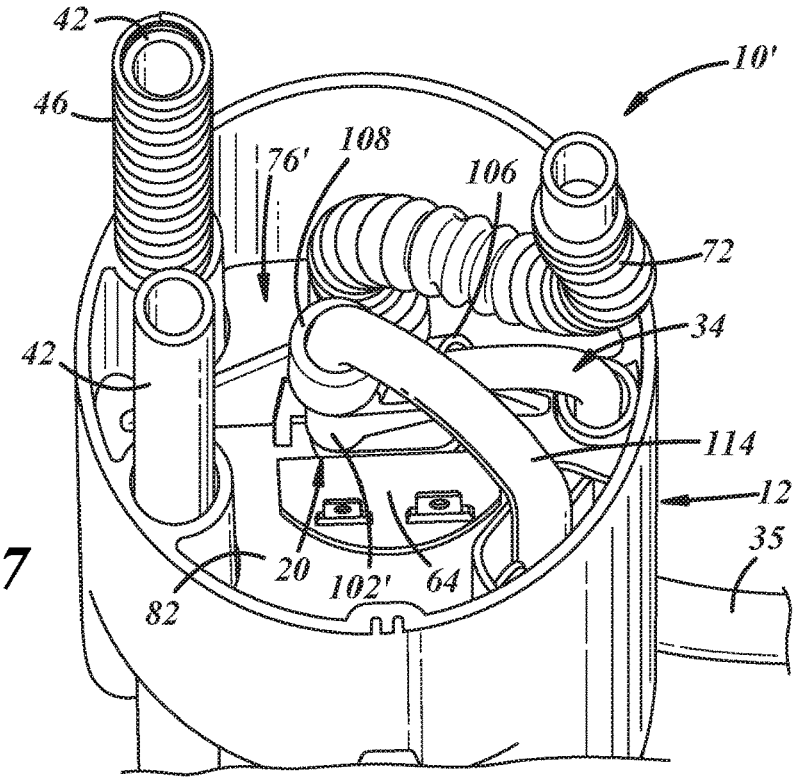
FIG. 7 is a perspective view of a fuel pump assembly like that shown in FIG. 5 including a second pump body that is formed integrally with a carrier received within the reservoir.

Further, as shown in FIG. 7, the fuel pump assembly 10' includes a second pump body 102' that is formed integrally with at least a portion of a carrier 76'. That is, the second pump body 102' and a portion of the carrier 76' may be integrally formed in the same piece of material, such as by being molded at the same time. This facilitates supporting and retaining the position of the second pump body 102', may reduce the cost and time to manufacture and assemble the components and the overall fuel pump assembly 10', may reduce vibrations of the carrier 76' and/or second pump body 102', and may facilitate electrically grounding the second pump body 102' and carrier to inhibit build-up of static electrical charges in the fuel pump assembly 10'. While shown as being formed integrally with the upper wall 82 of the carrier 76', the second pump body 102' could be otherwise located and communicated with an output fuel flow from the primary pump 14, as well as the intake tube 34 and the outlet tube 114. The reservoir 12, supports 42 and other components may be the same and so the same reference numerals have been used to facilitate description and understanding of the assembly 10'.

It is to be understood that the foregoing description is not a definition of the invention, but is a description of one or more preferred embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. For example, a method having greater, fewer, or different steps than those shown could be used instead. All such embodiments, changes, and modifications are intended to come within the scope of the appended claims.

As used in this specification and claims, the terms "for example," "for instance," "e.g.," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

What is claimed is:

1. A fuel pump assembly, comprising:

a reservoir having an internal volume and a reservoir inlet that communicates with the internal volume;

a primary fuel pump having a primary fuel pump inlet in communication with the internal volume, a primary fuel pump outlet through which fuel is discharged under pressure, an electric motor and a pumping element driven by the electric motor to take fuel into the primary fuel pump inlet and discharge fuel from the primary fuel pump outlet;

a secondary fuel pump having a body that defines a first inlet, a second inlet and a secondary fuel pump outlet, wherein the first inlet receives at least some of the fuel discharged from the primary fuel pump outlet, a nozzle is carried by the body or otherwise communicated with the first inlet so that fuel that flows out of the nozzle flows into the body via the first inlet, the second inlet is in communication with the reservoir inlet, and the secondary fuel pump outlet is in communication with the internal volume, wherein the flow of fuel through the nozzle creates a drop in pressure in the area of the second fuel inlet to draw fuel from the fuel source through the second fuel inlet and the fuel drawn in through the second fuel inlet is combined with the flow of fuel from the nozzle and the combined fuel flows are discharged from the secondary fuel pump outlet and into the internal volume, and wherein the second fuel inlet includes a portion that is higher than the nozzle with respect to gravity.

2. The assembly of claim 1 wherein the nozzle is received at least partially in the body and the body defines an area downstream of the nozzle that is larger in size than the flow area of the nozzle.

3. The assembly of claim 2 wherein the body is formed as a single piece of material such that the first inlet, second inlet and the secondary fuel pump outlet are features integrally formed in the same component.

4. The assembly of claim 2 wherein the body is formed from a material conductive to electrostatic charges.

5. The assembly of claim 1 wherein at least a portion of the second inlet or of a passage coupled to the second inlet is at an acute included angle of between 0 and 60 degrees relative to the direction of the force of gravity.

6. The assembly of claim 1 wherein the primary fuel pump includes a second outlet through which fuel is provided the first inlet, and wherein the secondary fuel pump outlet is coupled to a first end of an outlet tube, and wherein the outlet tube is bent and includes a portion that is located above a height of the second outlet relative to the force of gravity.

7. The assembly of claim 1 which includes a pick-up tube having a first end coupled to the reservoir and communicated with the reservoir inlet, and the pick-up tube has a second end spaced from the reservoir and spaced from the secondary fuel pump.

8. The assembly of claim 1 which includes an intake tube coupled at a first end to the reservoir and communicated with the reservoir inlet, and the intake tube has a second end coupled to the second inlet of the body.

9. The assembly of claim 1 which includes an intake tube coupled at a first end to the second inlet of the body and a second end that is remote from the reservoir.

10. The assembly of claim 9 wherein the intake tube extends from within the internal volume to a location outside of the internal volume.

11. The assembly of claim 10 wherein the intake tube is defined in part by a passage formed in the reservoir.

12. The assembly of claim 1 wherein the primary fuel pump includes an outlet body that defines the primary fuel pump outlet, and a hollow projection that defines a second outlet of the primary fuel pump, and a portion of the body of the secondary fuel pump that defines the first inlet is received over at least part of the hollow projection so that the body of the secondary fuel pump is coupled to the outlet body.

13. A fuel pump assembly, comprising:

a reservoir having an internal volume and a reservoir inlet that communicates with the internal volume;

a primary fuel pump having a primary fuel pump inlet in communication with the internal volume, a primary fuel pump outlet through which fuel is discharged under pressure, an electric motor and a pumping element driven by the electric motor to take fuel into the primary fuel pump inlet and discharge fuel from the primary fuel pump outlet;

a secondary fuel pump having a body that defines a first inlet, a second inlet and a secondary fuel pump outlet, wherein the first inlet receives at least some of the fuel discharged from the primary fuel pump outlet, a nozzle is carried by the body or otherwise communicated with the first inlet so that fuel that flows out of the nozzle flows into the body via the first inlet, the second inlet is in communication with the reservoir inlet, and the secondary fuel pump outlet is in communication with the internal volume, wherein the flow of fuel through the nozzle creates a drop in pressure in the area of the second fuel inlet to draw fuel from the fuel source through the second fuel inlet and the fuel drawn in through the second fuel inlet is combined with the flow of fuel from the nozzle and the combined fuel flows are discharged from the secondary fuel pump outlet and into the internal volume; and a flow controller carried by the reservoir and into which the fuel flow from the secondary fuel pump outlet is directed, wherein the flow controller includes a cavity and the secondary fuel pump outlet is defined at least in part by an outlet tube having an end that is received in the cavity.

14. The assembly of claim 13 wherein the secondary fuel pump outlet is coupled to a first end of an outlet tube and a second end of the outlet tube is received within the cavity.

15. The assembly of claim 14 wherein the flow controller includes a surface that is at an angle of between 45 and 90 degrees relative to the direction of fuel flow out of the secondary fuel pump outlet.

16. The assembly of claim 14 wherein the flow controller includes an opening above the level of the second end of the outlet tube relative to the direction of the force of gravity.

17. A fuel pump assembly, comprising:

a reservoir having an upper end, an internal volume defined below the upper end, and a reservoir inlet that communicates with the internal volume;

a primary fuel pump having a primary fuel pump inlet in communication with the internal volume, a primary fuel pump outlet through which fuel is discharged under pressure, an electric motor and a pumping element driven by the electric motor to take fuel into the primary fuel pump inlet and discharge fuel from the primary fuel pump outlet;

a secondary fuel pump having a body that defines a first inlet, a second inlet and a secondary fuel pump outlet, wherein the first inlet receives at least some of the fuel discharged from the primary fuel pump outlet, a nozzle is carried by the body or otherwise communicated with the first inlet so that fuel that flows out of the nozzle flows into the body via the first inlet, the second inlet is in communication with the reservoir inlet, and the secondary fuel pump outlet is in communication with the internal volume, wherein the flow of fuel through the nozzle creates a drop in pressure in the area of the second fuel inlet to draw fuel from the fuel source through the second fuel inlet and the fuel drawn in through the second fuel inlet is combined with the flow of fuel from the nozzle and the combined fuel flows are discharged from the secondary fuel pump outlet and into the internal volume; and a carrier received within the reservoir internal volume, in contact with the reservoir and having a wall that supports the primary fuel pump within the internal volume, and wherein the body of the secondary fuel pump is formed in the same piece of material as at least a portion of the carrier.

18. The assembly of claim 17 wherein the carrier includes an upper wall with an opening through which part of the primary fuel pump extends.

19. The assembly of claim 17 which also includes an outlet tube through which fuel discharged from the secondary fuel pump outlet flows, and wherein the carrier includes a cavity that defines a flow controller that at least partially opposes fuel flow out of the outlet tube.

20. The assembly of claim 19 wherein the outlet tube includes a first end connected to the secondary fuel pump outlet, and the outlet tube includes a second end that is received within the cavity so that the second end is below the level of an upper edge of the cavity, with respect to gravity.

* * * * *